United States Patent [19]

Huerth

[11] 4,125,951

[45] Nov. 21, 1978

[54] SNOW REMOVAL DEVICE

[75] Inventor: Arthur W. Huerth, Lake Zurich, Ill.

[73] Assignee: Chicago Etching Corporation, Chicago, Ill.

[21] Appl. No.: 795,198

[22] Filed: May 9, 1977

[51] Int. Cl.[2] ..... E01H 5/02

[52] U.S. Cl. ..... 37/53; 294/54; 294/57; 156/242; 37/130

[58] Field of Search ..... 37/41, 53, 130, 134; 294/54, 53, 55, 56, 57, 58; 15/236 R; 156/242; 280/47.26

[56] References Cited

U.S. PATENT DOCUMENTS

| | | | |
|---|---|---|---|
| 88,138 | 3/1867 | Craine | 294/55 |
| 111,939 | 2/1871 | Hubbard | 294/56 |
| 542,867 | 7/1895 | Wyman | 37/130 |
| 967,270 | 8/1910 | Tiedt | 294/54 |
| 1,937,243 | 11/1933 | Pearch | 37/41 X |
| 2,280,778 | 4/1942 | Andersen | 15/236 X |
| 2,357,114 | 8/1944 | Howe | 294/55 |
| 2,674,052 | 4/1954 | Newkirk | 37/41 X |
| 2,921,798 | 1/1960 | Cislak | 37/130 X |
| 3,007,263 | 11/1961 | Lair | 37/130 X |
| 3,063,174 | 11/1962 | Ludin | 37/130 |
| 3,380,772 | 4/1968 | Lissakers | 37/53 |
| 3,468,041 | 9/1969 | Mattson et al. | 37/50 X |
| 3,751,058 | 8/1973 | Larsen | 37/130 X |
| 3,774,930 | 11/1973 | Pravednekow | 37/130 X |

FOREIGN PATENT DOCUMENTS

| | | | |
|---|---|---|---|
| 681,680 | 3/1964 | Canada | 37/53 |
| 71,519 | 12/1942 | Czechoslovakia | 37/53 |
| 259,463 | 5/1913 | Fed. Rep. of Germany | 37/130 |

*Primary Examiner*—E. H. Eickholt

*Attorney, Agent, or Firm*—Alter and Weiss

[57] ABSTRACT

A device for the removal of snow without stooping, bending, or lifting. The device is constructed as a substantially flat panel arching upwardly at one end. A blade is fixedly attached to the leading edge of this flat panel. Raised side walls provide structural support and increase the volume of snow held. Likewise, a handle is attached for propulsion of the apparatus by a user. A sliding surface on the exterior of the flat panel enables propulsion of the device horizontally across pavement, thus removing the snow without lifting. A smooth surface on the interior of the device enables disposal of accumulated snow by rapidly pushing or "slinging" the device, thereby propelling the snow forward and out of the device.

22 Claims, 8 Drawing Figures

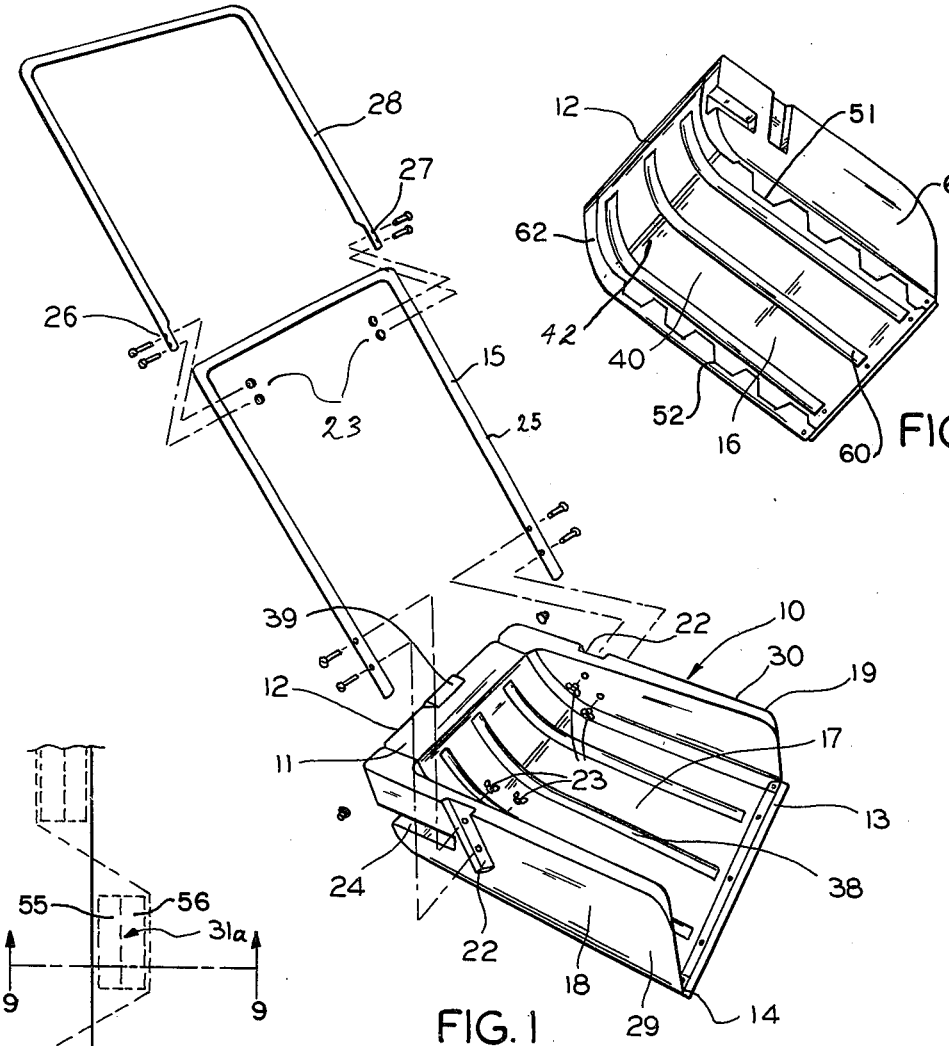
FIG. 1
FIG. 2
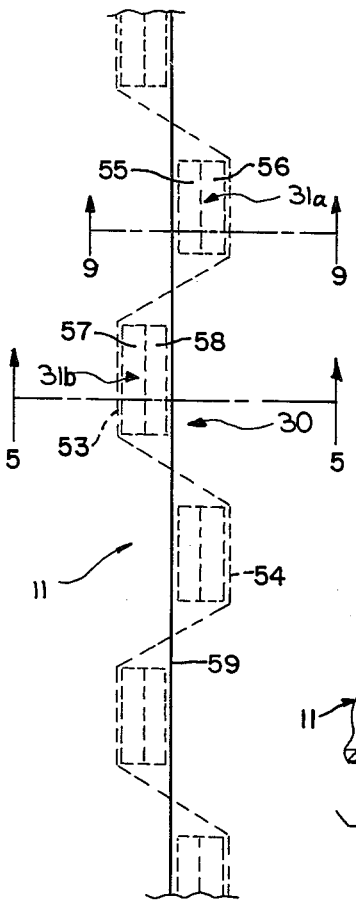
FIG. 4
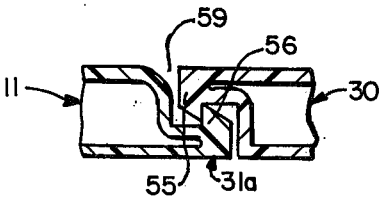
FIG. 9
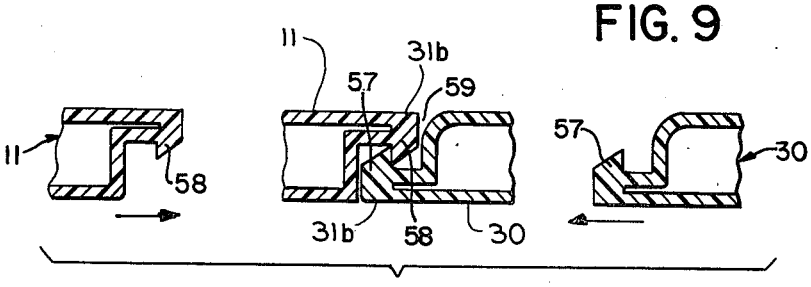
FIG. 5

SNOW REMOVAL DEVICE

BACKGROUND OF THE INVENTION

A recurring problem for homeowners and businesses during the winter months is the removal of snow from sidewalks, driveways and parking lots. The time and effort expended in such snow removal is often considerable. Particularly when the temperature is just below the freezing point, the snow is extremely heavy and difficult to remove without great effort. Such snow removal is frequently the cause of heart atacks, strokes, and many lesser ailments, such as muscle strains and sprains.

By and large, the most commonly used method of snow removal consists of the common snow shovel. Such shovels, while inexpensive and simple to operate, required fairly substantial muscular effort in order to remove any significant quantities of snow from the areas desired. Additionally, the common snow shovel requires the lifting and throwing of the snow a sufficient distance to clear the pavement. Snow shovels also frequently require bending and stooping.

Previous attempts to alleviate this problem have concentrated primarily in the area of powered mechanical snow-removal drives. An example of such a device is the household snow blower, the use of which has proliferated in recent years. A second means of snow removal has been a propelled plow, either as a self-contained unit, or attached to a truck or suiteable vehicle. The use of such conventional snow-removal devices, while satisfactory, is extremely expensive and not practical for the average homeowner. Consequently, the bulk of snow removal today is still accomplished through the use of the common snow shovel which is strenuous, cumbersome, and time consuming.

My invention has, therefore, the following objects:

to provide a snow removal device, enabling the removal of snow without bending, stooping, or lifting the snow to be removed;

to provide such devices in forms which are inexpensive to the consumer;

to provide such snow removal devices in a form which is simple to store;

to provide such snow removal devices in forms which are simple to manufacture.

SUMMARY OF THE INVENTION

The present invention is an improved snow-removal apparatus of molded plastic for the reduction of effort and time involved in such snow removal. The invention comprises a flat panel arching upwardly at one end referred to hereinafter sometimes as the main body member. Attached to the leading edge of the panel is a blade, which runs across substantially all of the leading edge. A handle is attached to the main body member of the propulsion of the device. The exterior surface of the main body member has essentially a smooth, even finish or sliding surface which enables the device to be moved across pavement or snow without lifting it from the ground. Consequently, the device can be propelled along the ground with the blade coming into contact with the pavement, in order to lift the snow from the ground. As this device is propelled, the snow is accumulated on the main body member. In order to remove snow from the device, the main body member is pointed towards a desired disposal area, and quickly accelerated by pushing the device forward. As the device is halted, the snow within the device continues of its own momentum and slides out of the device to the desired point of disposal.

In one embodiment of the invention, attached to the main body member are raised side walls, so that a more substantial quantity of snow can be accumulated in the device before being removed and so that removal itself is more effectively controlled.

In the preferred embodiment of the invention, the blade means comprises, a flat metal strip substantially the same width as the device. The main body member has a series of perforations along its leading edge. A first series of tabs cut in the flat metal strip correspond with the series of perforations in the main body member. These tabs project from the flat metal strip and are fixedly restrained within the perforations by means of bending.

In a further embodiment of the invention, these blades are removable and replaceable.

In an additional embodiment of the invention, the main body member has a curved exterior trailing edge so that the snow removal device can be tipped and rotated as desired. This is particularly useful in disposing of accumulated snow. The device is tipped and propelled to the side of the pavement being cleared. The raised leading edge of the device thereby rides up and over the snow at the sides of the pavement. The snow is then slid off the device and the user returns it to the pavement.

In substantially all of the embodiments of the invention, handle means are employed. One preferred embodiment of these handle means is a tubular U-shaped handle member. A set of handle-receiving slots is integrally formed in the main body member for telescopic reception of the handle member. A set of nuts and bolts, or other various handle retention means, are utilized to fixedly restrain the handle member within the handle-receiving slots. In a further embodiment of the invention, the handle means comprise two sets of these handle-receiving slots. One set of the slots is for the positioning of the handle member in its operative position. The second set of slots is for positioning the handle member in its storage position. The handle member, when in its storage position, is aligned with the longitudinal axis of the main body member, so as to facilitate vertical storage of the snow removal apparatus. Additionally, such vertical storage enables hooking of the device on a garage wall, which minimizes the space required for storage.

In an additional embodiment of the invention, the handle means comprises a pair of U-shaped tubular handle members. The first handle member is crimped at both ends. This enables the second handle member to be slidingly received by the first handle member. In particular, in one embodiment of the invention, the two ends of the U-shaped first handle member receive the opposite sides of the bottom of the U-shaped second handle member. Both the first and second handle members are then fixedly attached to each other so as to extend the length of the total handle means without loss of structural rigidity.

In a preferred embodiment of the invention, the raised side walls comprise a pair of side wall members juxtaposed on either side of the main body member. From a front perspective, the raised side walls are L-shaped. A second series of locking tabs is formed along one side edge of the side wall members. A corresponding third series of locking tabs is formed along the outside edge of the main body member. These second and third series of locking tabs allow the interlocking of the raised side walls with the main body member, each to one side of the body member respectively. The raised side wall members are also joined to the main body member by the attachment of the blade across the front of the device, thus connecting the side walls to the main body.

In a further embodiment, these second and third series locking tabs are recessed within the raised side wall members and the main body member, respectively. In this embodiment, when the second and third series of the locking tabs are overlapped, a smooth seam between each side wall member and the main member is created.

These locking tabs are particularly inventive, in that they substantially increase the structural rigidity of the main body member along its sides, thereby preventing buckling of the hollow main body member, and further maintaining the raised side walls in a fixed vertical position, so as to retain a large volume of snow within the device.

These locking tabs may be constructed in a number of varying configurations, as desired. Among these are male and female interlocking tab members, flat overlapping tab members with studs through the tabs, and hooking tab members which friction-lock, one with the other.

In a preferred embodiment of the invention, the snow removal apparatus includes an upper surface of the main body member arching downward to the leading edge of the main body member where it joins the lower surface, on adjacent to the blade. The same upper surface at its opposite end joins the trailing edge of the main body member. The upper surface is of a smooth finish which facilitates the sliding of snow thereon. These features comprise snow slide means which enable the easy accumulation of snow on the device, and which also facilitate propulsion of snow from the device.

In an additional embodiment of the invention, a series of support ridges is integrally formed in the upper surface of the main body member running parallel to the length of the main body member for the channeling of snow across the main body member and to provide increased structural rigidity.

An additional feature of the invention comprises gripping means integrally formed in the main body member to facilitate the carrying of the device by the user as required. In a preferred embodiment of the invention, the device is blow-molded of medium density polyethylene.

Additionally disclosed is a method for the construction of such a snow removal device which comprises molding a flat panel member and raised walls from thermoformable plastic. Locking tabs on the raised side walls are meshed with matching locking tabs on the flat panel member. The raised sidewalls are positioned on each of the two longitudinal sides of the flat panel member. Then before the pieces cool from molding, the locking tabs are malleted together. The locking tabs deform sufficiently to interlock together. A blade member is then affixed to the leading edges of both the flat panel member and the raised side walls, thus providing additional interlocking support.

BRIEF DESCRIPTION OF THE DRAWINGS

FIG. 1 of the drawings is a side perspective view of an improved snow removal device, including an exploded view of the handle means, with dotted lines indicating handle attachment means.

FIG. 2 is a bottom perspective view of the apparatus.

FIG. 4 of the drawings is an enlarged top plan view view of the seam running between the upper surface of the main body member and a juxtaposed sidewall member, showing in particular, a schematic of locking tab means between the raised sidewall means and the main body member means within each.

FIG. 5 of the drawings is a side cutaway perspective of FIGS. 2 and 4 taken along lines 5—5 and looking in the direction of the arrows of the locking means, showing in particular, the joining of the second and third series of locking tab members.

FIG. 9 of the drawings is a cross sectional view of the locking means of FIGS. 2 and 4 taken along line 9—9 and looking in the direction of the arrows.

DETAILED DESCRIPTION OF THE DRAWINGS

Figure 3:
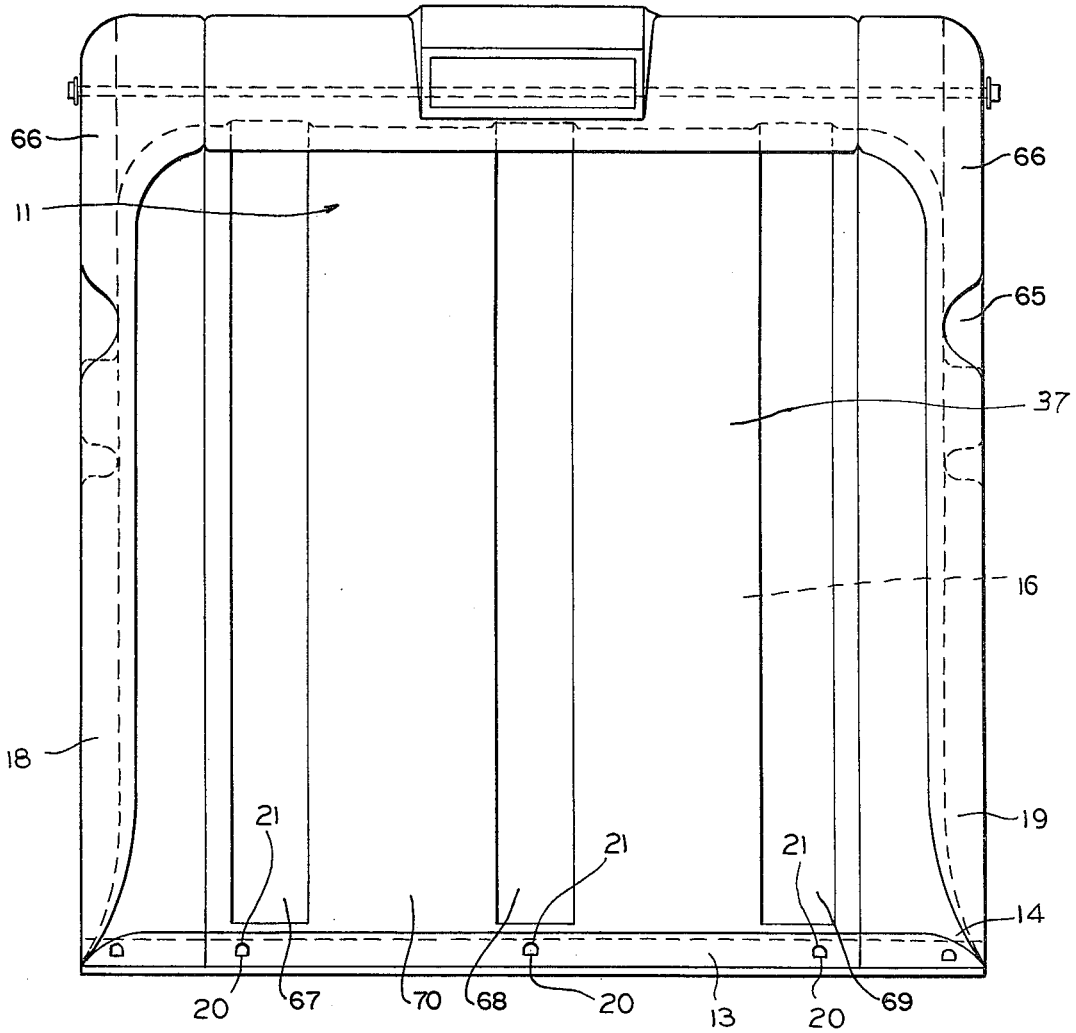
FIG. 3 of the drawings is a top view of one embodiment of the invention, showing in particular, blade means and blade attachment means, as well as a series of support ridges integrally formed in the main body.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

Plastic molded snow removal device 10, as shown in FIG. 1, comprises a main body member 11, formed as a substantially flat panel arching upwardly at a first end 12, with blade means 13 attached to the leading edge 14 of the main body member. Handle means 15 are attached to the snow removal apparatus for propulsion of the device.

Additionally shown in FIG. 1 are raised sidewall means 18 and 19 for the retention of accumulated snow within the apparatus, as well as alternative handle slots 22 and 24, gripping means 39 and channel ridge 17. Channel ridge means 17, within the main body member, enables facilitated snow accumulation within the device by rapid acceleration and removal by deceleration, and reinforces the structure of the main body member while providing proximate recesses such as recess 38 which serve to drain water from the accumulated snow.

As shown in FIG. 2, a curved exterior trailing edge 42, along first end 12 of main body member 11, allows the device to be angularly displaced or tipped, and rotated so as to maneuver the device as required. Additionally, a smooth continuous bottom surface 16 is utilized to facilitate sliding of the device across pavement or runners such as runner 60 can be utilized. Seams 51 and 52 arise out of the juxtaposition and locking of the second series of locking tabs on side members 61 and 62 with the third series of locking tabs on side of the main body member 11.

As shown in FIG. 3, blade means 13 comprises a flat metal strip of substantially the same width as the leading edge 14 formed between the main body member 11 and raised sidewalls 18 and 19. A series of perforations 20, in the leading edge 14 of the main body member 11, allows insertion of a first series of raised locking tabs 21, aligned with the series of perforations 20. This first series of raised tabs are inserted through the perforations 20 in the leading edge 14, and then bent downward, thus attaching blade means 13 to leading edge 14 while further binding the sidewalls to the main body member.

As more appropriately shown in FIG. 1 handle means 15 fits into a plurality of handle receiving slots 22, integrally formed in raised sidewalls 18 and 19 for the telescopic reception of handle means 15. Handle retention means 23 are utilized to restrain the handle member 25, within the handle receiving slots 22. Handle means 15, can also be affixed within a second set of handle receiving slots 24, is integrally formed in the sidewalls proximate first end 12 of device 10. The second set of handle receiving slots 24, is used for positioning handle member 25 in its storage position. Handle retention means 23, or equivalent one are utilized to restrain handle member 25 in handle receiving slots 24. This positioning of the handle member 25 in a storage position facilitates storage of the device 10, and in particular, allows the device to be hung on a hook in a garage or shed.

In another embodiment, of the invention shown in handle means 15 further comprises a second U-shaped member 28, curvedly crimped at both ends 26 and 27 so as to enable first U-shaped member 25 to slidingly receive second handle member 28. A second set of handle retention means 23, is utilized to fixedly attach first handle member 25 to second handle member 28.

In a preferred embodiment of the invention, raised side walls means 17 and 18 comprise a pair of raised side wall members 29 and 30. A series of locking tab joint 31*a*, and *b* as shown in FIG. 4, is formed along the inside edge of each of side wall members 29 and 30, and main body member 11. These locking tab joints 31 *a* and *b* are formed by the connection of the third series of locking tabs such as tabs 55 and 57 in main body member 11, so as to interlock with the second series of locking tabs such as locking tabs 56 and 58 in sidewall member 30. Accordingly, the main body and sidewalls form a single unit for the retention, and disposal of accumulated snow. Both FIGS. 5 and 9 denote in greater detail the manner in which tabs 55 and 56, as well as tabs 57 and 58 interlock when members 30 and 11 are joined in the indicated directions to form straight seam 59.

Figure 6:
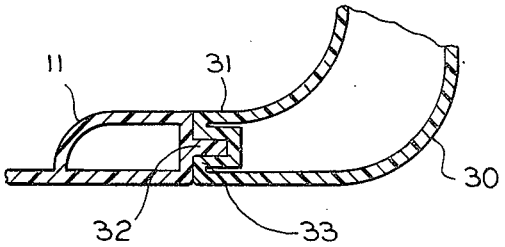
FIG. 6 of the drawings is a side cutaway view of another embodiment of locking tab members being interconnected for juxtaposing the main body members and sidewall.

In a further embodiment of the invention, shown in FIG. 6, a fourth series of locking tab means 31, comprise a plurality of male locking tab members 32, integrally formed in the main body member 11 and a plurality of female locking tab members 33, integrally formed in the side wall member 29. These male and female locking tab members 32 and 33, have a friction fit, each in the other, thus the side wall member 30 is fixedly attached to the main body member 11.

Figure 7:
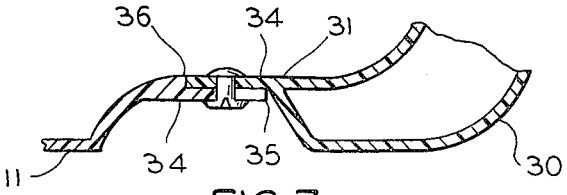
FIG. 7 of the drawings is a side cutaway view of an additional embodiment of locking tab means showing flat locking tabs overlapped in flat locking tab-receiving slots and stud means fixedly attaching said flat locking tabs for juxtaposing the main body members and sidewall.

In a further embodiment, seen in FIG. 7, a fifth series of locking tab means 31 comprise a plurality of flat locking tabs 34, extending from both the side wall member 29 and the main body member 11. The flat locking tab members 34 overlap and stud means 36 are used to fixedly attach flat locking tab members 34 together, so as to join the main body member 11 with side wall members 29 and 30.

Returning to FIG. 3, one further embodiment of the invention utilizes support ridges such as ridges 37 and 70 and recesses such as recesses 67 through 69. Handle slots 65 and 66 are also shown in this view integrally formed in the main body member 11 for the channeling of snow across main body member 11 and to provide increased structural rigidity.

Figure 8:
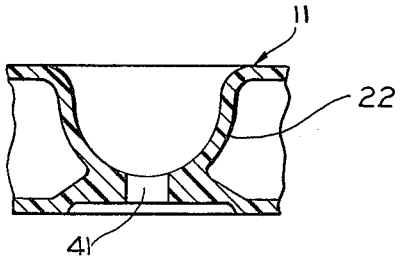
FIG. 8 of the drawings is a side cutaway view of one embodiment of a handle-receiving slot.

As shown in FIG. 8 of the drawings, handle-receiving slot 22 comprises a semi-circular groove formed in the side wall member 19 of FIG. 1, which is designed to telescopically receive and closely support handle means 15 (not shown). Bore member 41 is designed to telescopically receive handle retention means 23 therein, the combination of handle receiving slot 22 and handle retention means 23 provides a rigid connection between handle means 15 and sidewall 19 and in turn main body member 11.

The foregoing description and drawings merely explain and illustrate the invention and the invention is not limited thereto, except in so far as the amended claims are so limited, as those skilled in the art who have the disclosure before them will be able to make modifications and variations therein without departing from the scope of the invention.

I claim:

1. A snow removal apparatus which comprises:

a substantially flat main body member of molded plastic arching upwardly at a first end;

a plurality of raised side wall means of molded plastic each of which is rigidly attached along one side of said main body member to provide rigid support to said apparatus while increasing its snow removal capacity;

blade means fixidly attached to the leading edge of said main body member at a second end;

handle means fixedly attached to each of said raised side wall means for facilitating the propulsion of said snow removal apparatus;

said handle means further comprising one or more integrated grooves recessed into each of said raised side walls for increased handling of said apparatus and handle member means attachable to said apparatus through telescopic receipt by said grooves and affixed thereto by handle retention means;

a substantially smooth horizontal bottom surface member across the exterior of said main body member;

said smooth horizontal bottom surface member enabling said device to be slid pavement in a horizontal position;

said smooth horizontal bottom surface member gradually curving upwardly proximate to said first end of said main body member to allow controlled gradual tilting of said apparatus through said handle means;

each of said side wall means and said main body member being independently formed of said plastic material and attached to one another through a second and third series of interlocking tab means, said second series of interlocking tab means integrally formed into each of said plurality of side walls means, said third series of interlocking tab means integrally formed on each side of said main body means;

said second and third interlocking tab means merging together to restrainably affix said side wall means to said main body means through the positive locking and interaction of tabs emanating therefrom.

2. The invention according to claim 1 in which said raised side wall means further comprises:

a pair of side wall members corresponding in cross-section to said main body member, said pair of side walls being L-shaped as seen from a front perspective;

said second series of locking tab means formed along the edge of each of said side wall members;

said third series of locking tab means correspondingly formed along the side edges of said main body member.

said second and third series of locking tab means allowing the interlocking of said raised side wall with said main body member, each to one side of said main body member, respectively, said blade means further securing said side wall members to said main body member.

3. The invention according to claim 1 in which said second and third series of locking tab means comprises:

a plurality of male locking tabs integrally formed in said main body means:

a plurality of male locking tabs integrally formed in each of side wall means;

each of said male locking tabs in said second series sliding past said male locking tabs in said third series and snapping behind said third series tabs so as to positively lock and affix said side wall means to said main body.

4. The invention according to claim 1 in which said second and third series of locking tab means comprises:

a plurality of flat locking tabs extending from said side wall members and main body member;

a plurality of flat locking tab receiving slots integrally formed about said flat locking tab members;

said flat locking tab members overlapping in said flat locking tab receiving slots; and stud means fixidly attaching said flat locking tabs in pairs together, one tab from said main body member and one tab from said side wall member.

5. The invention according to claim 1 in which said blade means comprises:

a flat metal strip of substantially the same width as said main body member;

a series of perforations in the leading edge of said main body member; and a first series of raised locking tabs cut in said flat metal strip corresponding with said series of perforations, said tabs projecting from said flat metal strip and being fixedly restrained within said series of perforations.

6. The invention according to claim 1 in which said handle member comprises:

a first substantially tubular U-shaped handle.

7. The invention according to claim 6 in which said substantially tubular handle member further comprises:

a second U-shaped substantially tubular handle, said second substantially tubular U-shaped handle being curvedly crimped at both ends so as to enable said first handle to be slidingly received by said second handle;

handle joinder means for fixedly attaching said first handle to said second handle so as to extend said handle means to a convenient height without loss of structural rigidity.

8. The invention according to claim 1 in which said handle means further comprises:

a second set of said handle receiving grooves, said second set of handle receiving grooves being integrally formed into each of said raised side wall means and being recessed therewithin for unobtrusive telescopic receipt of said handle member, said second set of said handle receiving grooves positioning said handle member into a storage position, said handle member in its storage position being coplanar with said main body member so as to facilitate vertical storage of said snow removal apparatus;

said handle member in its storage position thereby facilitating hooking of said snow removal apparatus on a garage wall.

9. The invention according to claim 1 wherein the invention further comprises snow slide means, said snow slide means comprising:

a substantially horizontal upper surface of said main body member, said substantially horizontal upper surface arching downwardly at its leading edge so as to join said lower surface of said main body member, said upper surface at its opposite end arching upwardly to said trailing edge of said main body member;

said upper surface being of a smooth finish so as to facilitate the sliding of snow onto and off of said apparatus, thereby acting as a receptacle for said snow.

10. The invention according to claim 1 in which said main body member further comprises:

gripping means integrally formed in said main body member to facilitate carrying of said device.

11. The invention according to claim 1 in which said snow removal apparatus further comprises:

a series of support ridges integrally formed in said main body member for the channeling of snow across said main body member and to provide increased structural rigidity.

12. The invention according to claim 1 in which said main body member and said side wall means are each constructed of blow-molded plastic;

said main body member and side wall means thereby having a substantially double-walled hollow construction to lighten said apparatus while substantially increasing structural rigidity.

13. A method for the construction of a snow removal device having a substantially flat panel member arching upwardly at one end, a blade member fixedly attached to the leading edge of the device, raised sidewall members attached to respective sides of said panel member, and a sliding surface on the exterior of the device, said method comprising the steps of:

molding said substantially flat panel member having locking tab means integrally formed along its outside edges, from thermoformable plastic material, molding a pair of said raised sidewall members having locking tab means integrally formed along their inside edges from thermoformable plastic material;

positioning, prior to cooling, said raised sidewall means on respective sides of said substantially flat panel member;

meshing, prior to cooling, said locking tabs on said flat panel member with said locking tabs formed on the inside edges of said raised sidewall members, malleting, prior to cooling, said locking tabs together, so as to cause deformation of said locking tabs into interlocking pairs, fixedly attaching said blade member to the leading edge of said flat panel member and said raised side-wall members.

14. A snow removal apparatus which comprises:

a substantially flat main body member of molded plastic arching upwardly at a first end;

a plurality of raised side wall means of molded plastic each of which is rigidly attached along one side of said main body member to provide rigid support to said apparatus while increasing its snow removal capacity;

blade means fixedly attached to the leading edge of said main body member at a second end;

handle means fixidly attached to each of said raised side wall means for facilitating the propulsion of said snow removal apparatus;

said handle means further comprising one or more integrated grooves recessed into each of said raised side walls for increased handling of said apparatus, and handle member means attachable to said apparatus through telescopic receipt by said grooves and affixed thereto by handle retention means;

a substantially smooth horizontal bottom surface member across the exterior of said main body member;

said smooth horizontal bottom surface member enabling said device to be slid across pavement in a horizontal position;

said smooth horizontal bottom surface member gradually curving upwardly proximate to said first end of said main body member to allow controlled gradual tilting of said apparatus through said handle means; and said side wall means being ridiidly attached along said sides of said main body member through integral formation with said main body member thereby imparting to said snow removal apparatus a unitary construction among said side wall means and said main body member.

15. The invention according to claim 14 in which said blade means comprises:

a flat metal strip of substantially the same width as said main body member;

a series of perforations in the leading edge of said main body member; and a first series of raised locking tabs cut in said flat metal strip corresponding with said series of perforations, said tabs projecting from said flat metal strip and being fixedly restrained within said series of perforations.

16. The invention according to claim 14 in which said handle member comprises:

a first substantially tubular U-shaped handle.

17. The invention according to claim 16 in which said substantially tubular handle member further comprises:

a second U-shaped substantially tubular handle, said second substantially tubular U-shaped handle being curved crimped at both ends so as to enable said first handle to be slidingly received by said second handle;

handle joinder means for fixedly attaching said first handle to said second handle so as to extend said handle means to a convenient height without loss of structural rigidity.

18. The invention according to claim 14 in which said handle means further comprises:

a second set of said handle receiving grooves, said second set of handle receiving grooves being integrally formed into each of said raised side wall means and being recessed therewithin for unobtrusive telescopic receipt of said handle member, said second set of said handle receiving grooves positioning said handling member into a storage position, said handle member in its storage position being coplanar with said main body member so as to facilitate vertical storage of said snow removal apparatus;

said handle member in its storage position thereby facilitating hooking of said snow removal apparatus on a garage wall.

19. The invention according to claim 14 wherein the invention further comprises snow slide means, said snow slide means comprising:

a substantially horizontal upper surface of said main body member, said substantially horizontal upper surface arching downwardly at its leading edge so as to join said lower surface of said main body member, said upper surface at its opposite end arching upwardly to said trailing edge of said main body member;

said upper surface being of a smooth finish so as to facilitate the sliding of snow onto and off of said apparatus, thereby acting as a receptacle for said snow.

20. The invention according to claim 14 in which said main body member further comprises:

gripping means integrally formed in said main body member to facilitate carrying of said device.

21. The invention according to claim 14 in which said snow removal apparatus further comprises:

a series of support ridges integrally formed in said main body member for the channeling of snow across said main body member and to provide increased structural rigidity.

22. The invention according to claim 14 in which each of said main body member and said side wall means of said unitary integrated construction are constructed of blow-molded plastic;

said main body member and side wall means thereby having a substantially double walled hollow construction to lighten said apparatus while substantially increasing structural rigidity.

* * * * *

UNITED STATES PATENT AND TRADEMARK OFFICE

CERTIFICATE OF CORRECTION

PATENT NO. : 4,125,951

DATED : November 21, 1978

INVENTOR(S) : Arthur W. Huerth

It is certified that error appears in the above-identified patent and that said Letters Patent are hereby corrected as shown below:

Col. 1, line 19: "required" should be --require--;
Col. 1, line 27: "drives" should be --devices--;
Col. 1, line 54: "of" should be --for--;
Col. 3, line 54: Between "raised" and "walls", insert --side--;
Col. 4, line 15: After "of", insert --of the locking means";
Col. 4, line 16: After "arrows", delete "of the locking means";
Col. 5, line 27: "one" should be --ones--;
Col. 5, line 32: Delete "of the invention shown in";
Col. 5, line 37: "23" should be --23'--;
Col. 5, line 40: "walls" should be --wall--;
Col. 5, line 41: "joint" should be --joints--;
Col. 6, line 53: Between "slid" and "pavement", insert --across--;
Col. 7, line 26: Before "side wall", insert --said--;
Col. 9, line 37: "rididly" should be --rigidly--;
Col. 10, line 2: "curved" should be --curvedly--;
Col. 10, line 17: "handling" should be --handle--.

Signed and Sealed this

*Twenty-sixth* Day of *February 1980*

[SEAL]

*Attest:*

SIDNEY A. DIAMOND

*Attesting Officer*

*Commissioner of Patents and Trademarks*